US009933159B2

(12) United States Patent
Saisho

(10) Patent No.: US 9,933,159 B2
(45) Date of Patent: Apr. 3, 2018

(54) OIL DIFFUSION PUMP AND VACUUM FILM FORMATION DEVICE

(71) Applicant: SHINCRON CO., LTD., Kanagawa (JP)

(72) Inventor: Shinichiro Saisho, Kanagawa (JP)

(73) Assignee: SHINCRON CO., LTD., Kanagawa (JP)

( * ) Notice: Subject to any disclaimer, the term of this patent is extended or adjusted under 35 U.S.C. 154(b) by 229 days.

(21) Appl. No.: 14/774,403

(22) PCT Filed: Mar. 14, 2013

(86) PCT No.: PCT/JP2013/057145
§ 371 (c)(1),
(2) Date: Sep. 10, 2015

(87) PCT Pub. No.: WO2014/141421
PCT Pub. Date: Sep. 18, 2014

(65) Prior Publication Data

US 2016/0037587 A1 Feb. 4, 2016

(51) Int. Cl.
*F04F 9/00* (2006.01)
*F23D 99/00* (2010.01)
(Continued)

(52) U.S. Cl.
CPC ..... *F23D 91/04* (2015.07); *F04F 5/20* (2013.01); *F04F 5/40* (2013.01); *F04F 9/00* (2013.01);
(Continued)

(58) Field of Classification Search
CPC .... F04F 9/00; F04F 9/06; F23D 91/04; F24H 2250/08
USPC ..... 417/152, 153, 154
See application file for complete search history.

(56) References Cited

U.S. PATENT DOCUMENTS 2,112,037 A * 3/1938 Malter ..... F04F 9/00 417/154
2,465,590 A * 3/1949 Hickman ..... F04F 9/00 417/152
(Continued)

FOREIGN PATENT DOCUMENTS

JP 2007-23778 A 2/2007
JP 2011-54381 A 3/2011
JP 2011-255250 A 12/2011

OTHER PUBLICATIONS

International Search Report for PCT/JP2013/057145 dated Jun. 18, 2013.

*Primary Examiner* — Patrick Hamo
(74) *Attorney, Agent, or Firm* — Kenealy Vaidya LLP

(57) ABSTRACT

Provided is an oil diffusion pump equipped with an oil vapor generator capable of eliminating the problems occurring when a heater wire is used as a heating source for an operating oil. The present invention is a vacuum pump for which an oil vapor generator (70) is arranged within a casing (51) and this oil vapor generator is operated to vaporize an operating oil (8), thereby producing oil vapor and this oil vapor is sprayed from a jet (53, 53*a*) to exhaust intake air. The oil vapor generator (70) is equipped with: a container (71, 72) in the interior of which oil is stored, with the lower end of the tubular member (71), which comprises a material to be heated, being closed; and induction coil (75) wrapped around the atmosphere-side perimeter of the tubular member (71) (in particular, the case inner wall (71*b*)) with an insulating material (73) therebetween; and a power supply means that applies a low-frequency alternating current of several tens of Hz to several hundreds of Hz to the induction coil (75). The configuration is such that the tubular member (71) itself is heated when the power supply means is operated and the low-frequency alternating current is applied to the induction coil (75), thereby vaporizing the oil within the container.

4 Claims, 4 Drawing Sheets

(51) Int. Cl.
*F04F 5/20* (2006.01)
*F04F 5/40* (2006.01)
*H05B 6/10* (2006.01)

(52) U.S. Cl.
CPC ..... *H05B 6/108* (2013.01); *F24H 2250/08* (2013.01)

(56) References Cited

U.S. PATENT DOCUMENTS 3,224,665 A * 12/1965 Milleron ..... F04F 9/00 338/282
3,391,857 A * 7/1968 Lucas ..... F04F 9/00 417/153
4,296,295 A * 10/1981 Kiuchi ..... H05B 6/1245 219/624
5,137,429 A * 8/1992 Broadhurst ..... F04F 9/00 417/152
6,767,192 B2 * 7/2004 Hablanian ..... F04F 9/04 417/152
6,873,102 B2 * 3/2005 Martelli ..... H01J 7/183 313/553
7,205,512 B2 * 4/2007 Takagi ..... H05B 6/145 219/619
2008/0048108 A1 * 2/2008 Barkus ..... F04F 9/00 250/282
2011/0315676 A1 * 12/2011 Yang ..... H05B 6/108 219/630
2016/0195301 A1 * 7/2016 Gaspard ..... H05B 6/365 392/441

* cited by examiner

OIL DIFFUSION PUMP AND VACUUM FILM FORMATION DEVICE

This application is a U.S. national phase filing under 35 U.S.C. § 371 of PCT Application. No. PCT/JP2013/057145, filed on Mar. 14, 2013, which is hereby incorporated by reference in its entirety.

TECHNICAL FIELD

The present invention relates to an oil diffusion pump, which is connected to a vacuum chamber constituting a variety of vacuum film formation devices, such as a vapor deposition device and a sputtering device, and suitably used for evacuating inside the chamber, and a vacuum film formation device incorporating the pump.

BACKGROUND ART

In a variety of vacuum film formation devices, such as a vapor deposition device and sputtering device, an oil diffusion pump is used as a vacuum pump used in an exhaust device for evacuating inside a vacuum chamber constituting the device. In oil diffusion pumps of the related art, those using an electric heater including a heater wire as a heating source for an operating oil held in a boiler are known (Patent Document 1).

RELATED ART DOCUMENTS

Patent Document

Patent Document 1: Japanese Unexamined Patent Publication (Kokai) No. 2007-23778

SUMMARY OF THE DISCLOSED SUBJECT MATTER

When using a heater wire as a heating source for an operating oil, it is advantageous that the device can be formed inexpensively, however, it involves elements of causing various troubles, such as losing a heating function due to disconnection of the heater wire, arising of a current leakage due to an insulation defect of the heater wire and arising of a contact defect of a terminal board due to a high temperature. Also, when using a heater line, since the temperature becomes red-hot high, a position to be attached has to be determined cautiously and there is a disadvantage that a degree of freedom is limited when selecting the installation position.

Furthermore, a heater wire as an operating oil heating source exhibits a large loss in heat conduction also in terms of an energy efficiency, which results in the possible disadvantages below.

(1) wasteful power consumption
(2) slow heat rising time (taking long time at start-up)
(3) being poor in heat response and maintenance
(4) requiring to select a material, which is heat resistant for a long period, as a material of an object to be heated
(5) resulting in also heating periphery of an object to be heated together with the object to be heated, which does not contribute to heating of an operating oil, etc.

According to an aspect of the present invention, there are provided an oil diffusion pump comprising an oil vapor generator capable of eliminating disadvantages in using a heater wire as a heating source for an operating oil, ensuring little failure and being contributable to energy saving at operation, and a vacuum film formation device using the pump as an exhaust device.

An oil diffusion pump in the present invention is a vacuum pump provided with an oil vapor generator arranged in a jet provided in a casing, wherein the oil vapor generator is operated to vaporize an operating oil to produce oil vapor and the oil vapor is sprayed from the jet for an operation to exhaust intake air. The oil vapor generator comprises a container for storing oil therein, which is a tubular member formed by a material to be heated with a lower end thereof being closed and provided to be along the upright direction; an induction coil wound around the tubular member via an insulating material provided therebetween; and a power supply means for applying a low frequency alternating current of several tens of Hz to several hundreds of Hz to the induction coil. It is configured that the power supply means is operated to heat the tubular member itself so as to vaporize the oil inside the container.

In the present invention, the tubular member of the oil vapor generator is configured to be provided along the upright direction and have a double structure of tubular inner wall and outer wall displaced on both sides of a cavity part having a ring shape in a circumferential direction, and the induction coil is wound around an atmosphere-side perimeter of the inner wall via the insulating material provided therebetween.

In the present invention, the induction coil is configured by an insulation-coated heat-resistant electric wire.

A vacuum film formation device of the present invention is provided with an exhaust device for evacuating inside a vacuum chamber, wherein the oil diffusion pump of the present invention is used as the exhaust device.

The oil vapor generator to be incorporated in the oil diffusion pump of the present invention uses as a heating source for an operating oil a tubular member made by a material to be heated (this will be a final heating body) with an induction coil wound around it via an insulating material provided therebetween. It is configured that a low frequency alternating current is applied to the coil to heat the tubular member itself and the heat vaporizes the operating oil.

According to the oil vapor generator to be incorporated in the oil diffusion pump of the present invention, instead of heating the coil, a low frequency alternating current is applied to the coil to generate a magnetic flux interlinking with the vertical upright direction of the tubular member, the generated magnetic flux generates an induced current, that is, an eddy current inside the tubular member and Joule heat is produced thereby (low frequency induced heating). The generated heat heats the tubular member itself (self-heating of the tubular member), consequently, the operating oil is heated.

Therefore, a loss of the heating function due to disconnection of the wire does not occur. Also, since all current is consumed by the tubular member itself as a heating body, an electric leakage due to an insulation defect does not occur. Because of the mechanism that the tubular member itself is heated by applying a low frequency alternating current to the coil instead of heating the coil, the coil itself does not become a heating body and a contact failure of a terminal board due to a high temperature does not occur, either. Furthermore, a degree of freedom becomes high in selecting a position of arranging the coil because of the feature that the heating source for an operating oil can be heated locally, which is advantageous.

Since the oil diffusion pump of the present invention incorporates the oil vapor generator of the present invention, all current applied to the coil of the oil vapor generator can be consumed by the tubular member as a heating body. As a result, there are advantageous points that heat response of the heating body can be improved, energy efficiency is enhanced, an energy consumption can be suppressed and heat rising time of an operating oil can be shorter (requires shorter start-up time), etc.

Note that, in the oil vapor generator of the present invention, since an upper end in the upright direction of the tubular member as a heating body, which is a wound induction coil, is exposed above the oil surface of the contact operating oil, oil vapor rising from the oil surface contacts with the upper portion of an inner wall of the tubular member exposed above the oil surface and is further heated, so that sufficiently heated oil vapor is generated. As a result, in an oil diffusion pump incorporating such an oil vapor generator, heat rising time of an operating oil can be attained in a further shorter time, which is extremely advantageous in terms of energy efficiency.

DESCRIPTION OF NUMERICAL NOTATIONS

1 . . . vacuum film formation device, 10 . . . vacuum chamber, 21, 23 and 25 to 29 . . . pipe, 31 . . . main evacuation valve 33 . . . leak valve, 35 . . . rough evacuation valve, 37 . . . auxiliary valve, 39 . . . leak value

50 . . . oil diffusion pump, 51 . . . casing, 53 . . . jet, 53*a* . . . jet nozzle, 55 . . . intake part, 57 . . . exhaust part, 58 . . . water cooling pipe

60 . . . rotary pump (oil rotation vacuum pump)

70 . . . oil vapor generator, 71 . . . tubular member (case), 71*a* . . . cavity part, 71*b* . . . case inner wall, 71*c* . . . case outer wall, 71*d* . . . case upper wall, 72 . . . lower lid, 73 . . . insulating material, 74 . . . heating body, 75 . . . induction coil, 76 . . . heatsink member, 77 . . . pipe, 78 . . . iron core, 79 . . . flange

8 . . . operating oil

Exemplary mode for carrying out the disclosed subject matter

Below, an example of the present invention will be explained based on the drawings.

Figure 1:
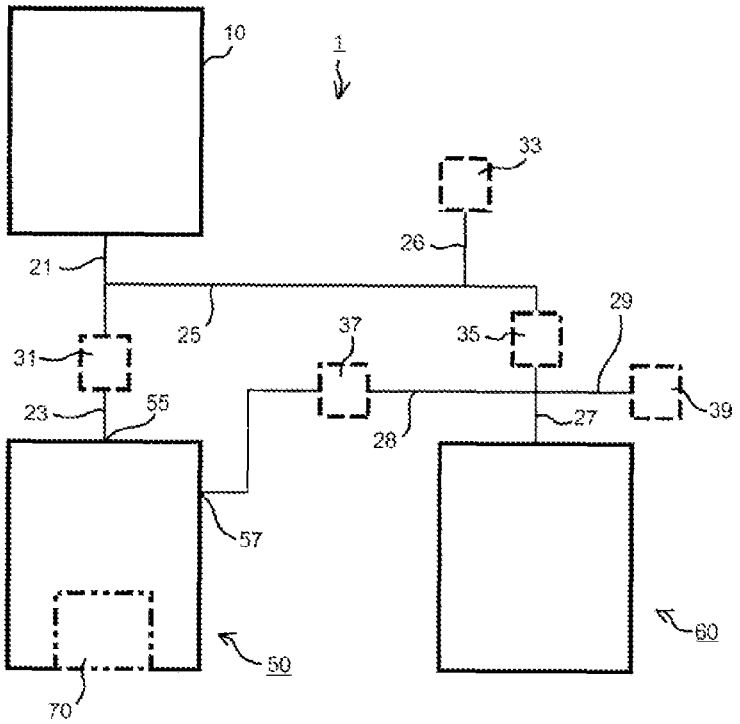
FIG. 1 is a schematic diagram showing a vacuum film formation device according to an example of the present invention.

As shown in FIG. 1, a vacuum film formation device 1 of the present example comprises a vacuum chamber (vacuum container) 10 as a device body provided inside thereof with a variety of equipment necessary for forming a thin film (film formation), such as a film formation source (illustration omitted) like a vapor source and sputter source, and a substrate holder for holding a substrate to be subjected to a treatment, etc. The chamber 10 is connected a downstream side of a pipe 21. The chamber 10 is connected with a vacuum meter (illustration omitted) and an atmospheric pressure (vacuum degree) inside the chamber 10 is detected.

The upstream side of the pipe 21 is connected to a downstream side of the intake pipe 23 via a main evacuation valve 31. The upstream side of the intake pipe 23 is connected to an intake part 55 of an oil diffusion pump (oil diffusion vacuum pump) 50. The middle of the pipe 21 is connected to the downstream side of a branch pipe 25. The middle of the branch pipe 25 is connected to the downstream side of a pipe 26, and a leak valve 33 is provided on the upstream side of the pipe 26.

The upstream side of the branch pipe 25 is connected to the downstream side of the pipe 27 via a rough evacuation valve 35. The upstream side of the pipe 27 is connected to a rotary pump (oil rotation vacuum pump) 60. The middle of the pipe 27 is connected to the downstream side of the pipe 28. The upstream side of the pipe 28 is connected to an exhaust part 57 of the oil diffusion pump 50 via an auxiliary valve 37. A joint part of the pipe 27 and the pipe 28 is connected to the downstream side of the pipe 29, and the upstream side of the pipe 29 is provided with a leak valve 39. A vacuum gauge (illustration omitted) is connected inside the pipe 28 to detect an atmospheric pressure (vacuum degree) in the oil diffusion pump 50.

In addition to the above, the vacuum film formation device 1 of the present example is provided with a control device (illustration omitted) for controlling an operation of the device 1. The control device provided in the present example is configured to comprise a main control circuit (illustration omitted) including a processing circuit like a CPU (central processing unit), a memory means (memory) built in the control circuit, a rotary pump control circuit (illustration omitted) for operating and controlling the rotary pump 60 and an oil diffusion pump control circuit (illustration omitted) for operating and controlling the oil diffusion pump 50.

The main control circuit is connected to a vacuum gauge drive circuit (illustration omitted) connected to the vacuum gauge connected inside the pipe 21. The main control circuit is connected to the respective valves (main evacuation valve 31, leak valves 33 and 39, rough evacuation valve 35 and auxiliary valve 37), and those valves are opened/closed in accordance with a predetermined sequence of the main control circuit. The oil diffusion pump 50 is connected to a rotary pump 60, and an exhaust air from the oil diffusion pump 50 through the auxiliary valve 37 is sucked by the rotary pump 60 and exhausted from a not shown path.

The rotary pump 60 in the present example functions as an auxiliary pump for maintaining a back pressure of the oil diffusion pump 50 used as a main pump and may be used also as a rough evacuation pump. The rotary pump 60 may be configured by an oil rotary pump, such as a rotary vane type. A rotary vane type oil rotary pump comprises a rotating rotor (illustration omitted) in a cylinder (illustration omitted). The cylinder has an intake port and an exhaust port, which are separate openings. The rotor is attached with a movable valve (illustration omitted), and an outer rim of the valve is pressed against an inner wall of the cylinder due to a centrifugal force of the rotor. As a result, when the rotor rotates, a volume formed by the rotor, valve and cylinder inner wall changes so as to discharge an air.

Figure 2:
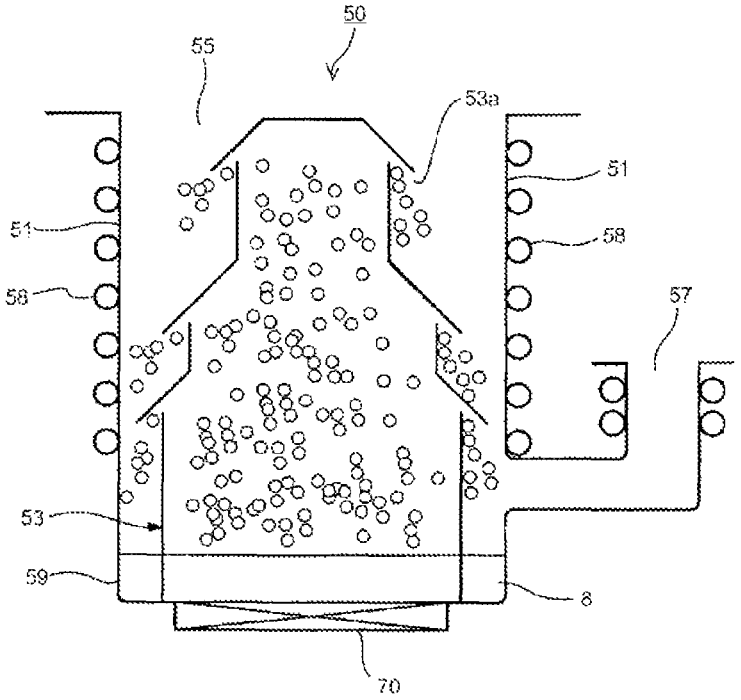
FIG. 2 is a schematic sectional diagram showing an oil diffusion pump as an example used in the vacuum film formation device in FIG. 1.

As shown in FIG. 2, the oil diffusion pump 50 of the present example has a tubular container (casing) 51 having a closed bottom. On the bottom inside the casing 51, an oil vapor generator 70 for heating and vaporizing an operating oil 8 is arranged. In the casing 51, a jet 53 is arranged where oil vapor, which is the operating oil 8 (refer to FIG. 3) heated by the oil vapor generator 70, vaporized and convected upward, is taken in and sprayed through a nozzle 53*a* to the discharging direction. The upper end of the casing 51 is provided with an intake part 55 and the side surface of the casing 51 is provided with an exhaust part 57.

Next, an operation of the oil diffusion pump 50 will be explained.

When the oil vapor generator 70 is operated after opening the main evacuation valve 31, the operating oil 8 is heated to around 230° C. and vaporized (oil vapor) by the oil vapor generator 70 and sprayed from the nozzle 53*a* to the inner sidewall of the casing 51. An air taken in from the intake part 55 (air inside the chamber 10) is blown to the jet flow direction by the spray and discharged from the exhaust part 57. Thereby, evacuation inside the chamber 10 is carried out. In FIG. 2, "circle (○)" indicates schematically a state of oil vapor, which is vaporized oil. Note that after spraying the oil vapor from the jet nozzle 53*a*, the intake part 55 is opened so that the operating oil 8 does not come into the chamber 10.

Also, the mechanism is that the casing 51 is cooled by the water cooling pipe 58, so that the oil vapor of the operating oil 8 adhered to the inner wall of the casing 51 is cooled and condensed, returns to an oil storage chamber 59 at a lower portion of the casing 51 and reheated by the oil vapor generator 70 to circulate.

Figure 3:
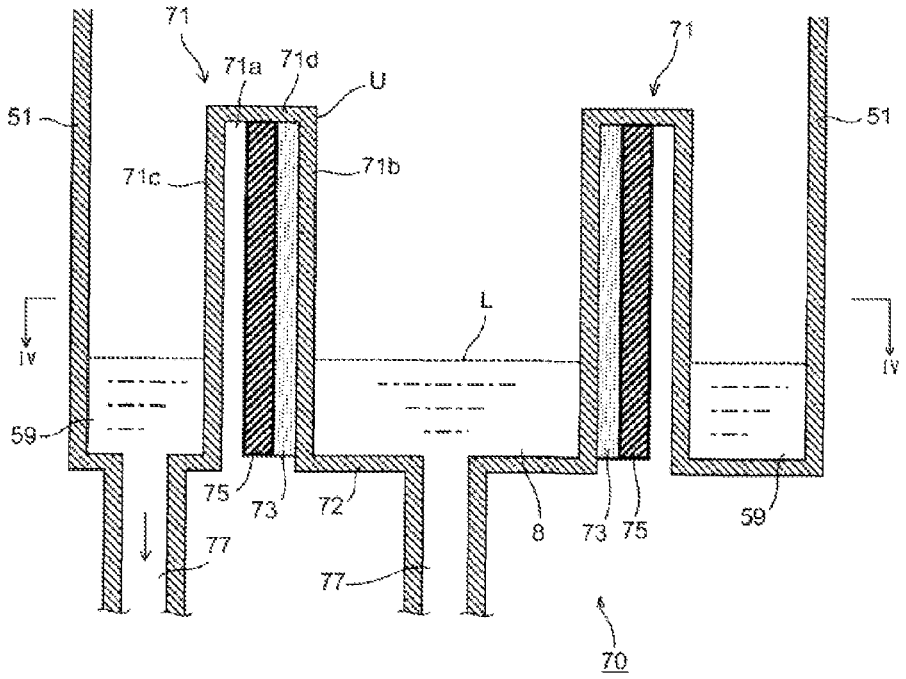
FIG. 3 is a schematic sectional diagram showing a key part of an oil vapor generator as an example used in the oil diffusion pump in FIG. 2.
Figure 4:
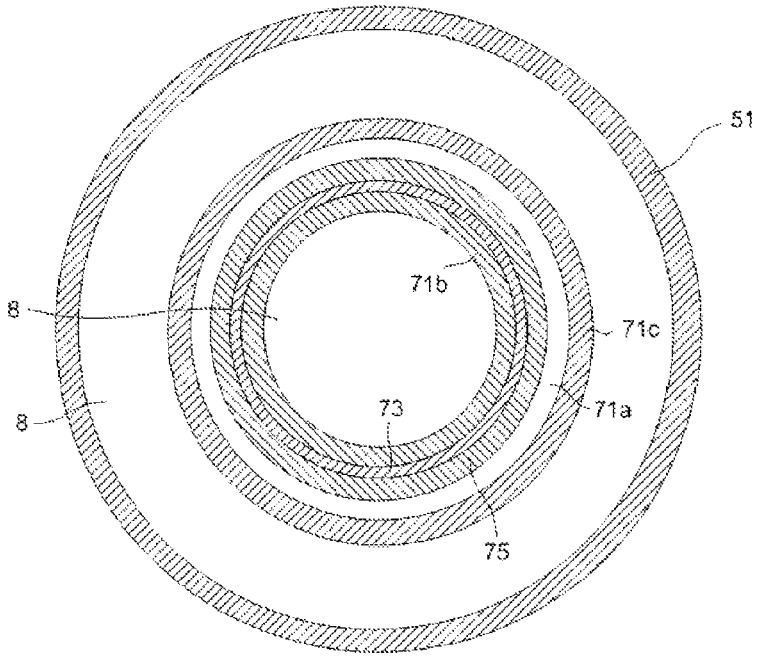
FIG. 4 is a sectional view along the line IV-IV in FIG. 3.

As shown in FIG. 3 and FIG. 4, the oil vapor generator 70 in the present example is arranged on the bottom inside the casing 51 of the oil diffusion pump 50 shown in FIG. 2 and has a tubular case (tubular member) 71 formed by a material to be heated as a part of a vacuum container. As the material to be heated, at least any one of stainless steel, carbon steel, rolled steel for general structure specified in JIS-G3101.

As stainless steel, all kinds of SUS may be used, for example, SUS304, SUS303, SUS302, SUS316, SUS316L, SUS 316J1, SUS316J1L, SUS405, SUS430, SUS434, SUS444, SUS429, SUS430F AND SUS302, etc. Carbon steel includes low carbon steel with a little carbon amount, such as soft steel materials, and high carbon steel with a large amount of carbon, such as hard steel materials. The rolled steel for general structure includes SS330, SS400, SS490 and SS540.

Among them, it is preferable to configure the case 71 with a ferromagnetic material subjected to a plating treatment having low electric resistance with resistivity of $10\times10^{-8}$ Ωm to $20\times10^{-8}$ Ωm or so, such as a soft steel material. When the case 71 is configured by a ferromagnetic material (soft steel, etc.) having low electric resistance, since electric resistance is low, an eddy current amount generated by application to the coil 75 becomes large, consequently, a self-heating amount by the case 71 itself becomes large and a high efficiency can be expected.

It is also preferable to configure the case 71 by a general steel SS400. Other than the above, the case 71 may be formed, for example, by a mold configured by a stainless clad steel sheet obtained by bonding a stainless steel thin sheet to an atmosphere-side surface of a material to be heated.

The case 71 has a double structure of tubular case inner wall 71*b* and case outer wall 71*c*, extending along the upright direction (vertical direction) of the case 71 and arranged concentrically to be on both sides of a cavity portion 71*a* having a ring shape in the circumferential direction. Upper surfaces of both the case inner and outer walls 71*b* and 71*c* are closed by a ring-shaped case upper wall 71*d*, and the lower faces of both the case inner and outer walls 71*b* and 71*c* are open in a ring shape. The bottom surface of the case 71 (case inner wall 71*b*) is closed by a lower lid 72. In the present example, a region surrounded by the case inner wall 71*b* and the lower lid 72 configures an oil storage chamber 59 (refer to FIG. 2), where the operating oil 8 is filled and stored. For example, when forming the case inner wall 71*b* and the case outer wall 71*c* to be 120 mm height, the operating oil 8 is filled such that an oil surface L level of the oil vapor generator 70 becomes 30 mm or so during stop of the operation. In that case, when the operation of the oil vapor generator 70 starts, the oil surface L level of the operating oil 8 decreases, for example, to 10 mm or so.

In the present example, it is preferable that the case inner wall 71*b* and the case outer wall 71*c* are formed to have a thickness in a range of 5 mm to 12 mm. Particularly, in low frequency induction heating, it is more advantageous if a thickness of the case inner wall 71*b* to be a heating body is thicker (for example, 8 mm to 10 mm or so) in terms of current penetration.

An induction coil 75 is wound around (on the cavity part 71*a* side, which is an atmosphere side in this example) the case inner wall 71*b* via an insulating material 73 provided therebetween. The insulating material 73 may be configured, for example, by a polyimide film having a thickness of 10 μm to 180 μm or so.

As a conducting wire composing the coil 75, an insulation-coated heat-resistant electric wire having small electric resistance and high heat resistance may be used. For example, an alumite electric wire, which is an aluminum wire subjected to an anodizing treatment, may be mentioned. A diameter of the wire constituting the coil 75 is preferably in a range of 2mm to 4 mm. The number of wound layers of the coil 75 is preferably in a range of 7 to 14 layers.

Note that the coil 75 is connected to a power supply means (illustration omitted) for applying a current (low frequency alternating current of several tens of Hz to several hundreds of Hz) to the coil 75 and a control device of the power source (control device) serially.

The case 71 is required to have strength (thickness) to maintain vacuum. Therefore, when using a high frequency, (1) it is liable that a skin effect arises on the case 71 (particularly on the case inner wall 71*b*) as a heating body. The skin effect here indicates a phenomenon focused on a conductive case inner wall 71*b* having a certain thickness, that a temperature arises only on a skin close to outer side comparing with the inner side and the rise of the temperature hardly transfers. When the skin effect appears, a heating efficiency of the operating oil declines. (2) In addition to the decline of the heating efficiency in the operating oil, it is concerned that a temperature of the coil 75 itself also rises due to a long-term operation of the oil diffusion pump.

When using a high frequency, (3) provision of an expensive inverter becomes necessary for generating a high frequency and a cost of the device may increase. (4) When providing a plurality of heater blocks, an interference of an induction current with respective heater blocks and a high frequency noise to be arisen may result in effects on other devices.

In the present example, a current to be applied to the coil 75 from the power supply means is a low frequency alternating current in order to prevent those disadvantages.

Next, an operation of the oil vapor generator 70 will be explained. When operating the power supply means and applying an alternating current having a frequency of 50 Hz or 60 Hz with a voltage of 200V (rms) and a current of 12 A (rms) to the coil 75, a magnetic flux interlinked with the vertical upright direction of the case 71 arises, and the flux generates an eddy current in the case 71 (case inner wall 71*b*) so as to generate Joule heat (low frequency induction heat). This heat heats the case 71 (case inner wall 71*b*) itself and, thereby, the operating oil 8 stored in the case 71 (a region surrounded by the case inner wall 71*b* and the lower lid 72) is heated directly. Oil vapor rising from the oil surface in the case 71 is furthermore heated by contacting with the upper portion of the heated case inner wall 7 lb being exposed above the oil surface, becomes a sufficiently heated high-temperature oil vapor, convects inside the jet 53 and is sprayed from the nozzle 53*a*.

As explained above, since the casing 51 of the oil diffusion pump 50 is cooled by the water-cooling pipe 58, oil vapor of the operating oil 8 adhered to the inner wall of the casing is cooled to be condensed and returns to the oil storage chamber 59 at the lower casing 51. Since the oil storage chamber 59 is connected to the region surrounded by the case inner wall 71*b* and lower lid 72 through the pipe 77, the operating oil after condensing and returning is heated again by the oil vapor generator 70 and vaporized again to circulate.

In the oil vapor generator 70 in the present example, the heating source for the operating oil to be used is obtained by winding induction coil 75 around the tubular case 71 (the case inner wall 71*b* in this example) formed by a material to be heated, such as a soft steel and SS400, via an insulating material 73 provided therebetween, the case inner wall 71*b* is heated by applying a low frequency alternating current to the coil 75 and the operating oil 8 is vaporized by the heat. Since the coil 75 is not heated, disconnection is not caused and the heating function is not lost by disconnection. Furthermore, since the coil 75 is not heated, the coil itself does not become a heating body and a contact failure of a terminal board due to a high temperature is not caused, either.

Since the oil vapor generator 70 of the present example is incorporated in the oil diffusion pump 50 of the present example, all current flown to the coil 75 of the oil vapor generator 70 can be consumed by the case 71 (the case inner wall 71*b* in this example). As a result, there are advantages such that thermal response of the case 71 as a heating body can be improved, the energy efficiency is high, an energy consumption can be suppressed, heat rising time of the operation oil 8 can be shorter (start-up time of the pump 50 can be shorter), etc.

In the oil vapor generator 70 of the present example, the upper end U in the upright direction of the case 71 (case inner wall 71*b*) as a heating body with the induction coil 75 wound around is exposed above the oil surface L of the contact operating oil, oil vapor rising from the oil surface L contacts with the upper portion of the case inner wall 71*b* being exposed above the oil surface L and furthermore heated thereby, so that sufficiently heated oil vapor is generated. As a result, in the oil diffusion pump 50 incorporating the oil vapor generator 70 of the present example, heat rising time of the operating oil 8 can become furthermore shorter, which is extremely advantageous in terms of the energy efficiency.

Note that the examples above are descried to facilitate understanding of the present invention and are not to limit the present invention. Accordingly, respective elements disclosed in the above examples include all design modifications and equivalents belonging to the technical scope of the present invention.

For example, in the example above, the induction coil 75 was wound around (on the atmosphere-side of) the case inner wall 71*b* formed by a soft steel material or SS400, etc. via an insulating material 73 provided therebetween, however, it is not limited to this mode and the functions and effects of the present example can be realized, for example, by the configuration explained below (refer to FIG. 5).

- Arranging a tubular heating body 74 extending along the inner wall surface (the vacuum side contacting with the operating oil 8) of the case inner wall 71*b*. Preferably, such a heating body 74 is arranged in a way that the upper end U is exposed above the oil surface L of the stored operating oil 8.
- The heating body 74 is formed by the steel materials mentioned in the example above (stainless steel, carbon steel, rolled steel for general structure and stainless clad steel sheet, etc.).
- At least a member (at least the case inner wall 71*b* in this example and may be the entire case 71) displaced between the heating body 74 and the induction coil 75 is formed by a material (stainless steel) having heat resistance, high electric insulating property and heat insulating property. It is to heat the operating oil efficiently with heat from the heating body 74.
- This member (case inner wall 71*b*) preferably has close planar contact with the heating body 74. Thereby, heat is transferred efficiently and the operating oil can be heated efficiently.
- A heatsink member 76 formed by a material having heat resistance, high electric insulating property and high heat conductivity (for example, aluminum nitride, etc.) is arranged around the induction coil 75. It is for releasing the heat of the coil 75 to outer wall (case outer wall 71*c*, etc.) and discharging efficiently to lower the temperature of the coil 75.
- An iron core 78 is arranged as a magnetic seal material around the heatsink member 76. It is for improving a power factor of the pump and enhancing the power use efficiency.
- A flange 79 for supporting the coil 75 and the iron core 78 from the atmosphere side (from below to above in FIG. 5 on the paper). It is to fix the coil 75 and iron core 78 to the pump.

Also, the functions and effects of the present example may be also obtained, for example, by the configuration (refer to FIG. 6) explained below.

The case inner wall 71*b* may be configured by a tubular heating body 74. In that case, an insulating material 73 (for example, a polyimide film having a thickness of 10 μ to 180 μm or so) is provided between the case inner wall 71*b* and the coil 75. Others are the same as the case in FIG. 5.

Figure 5:
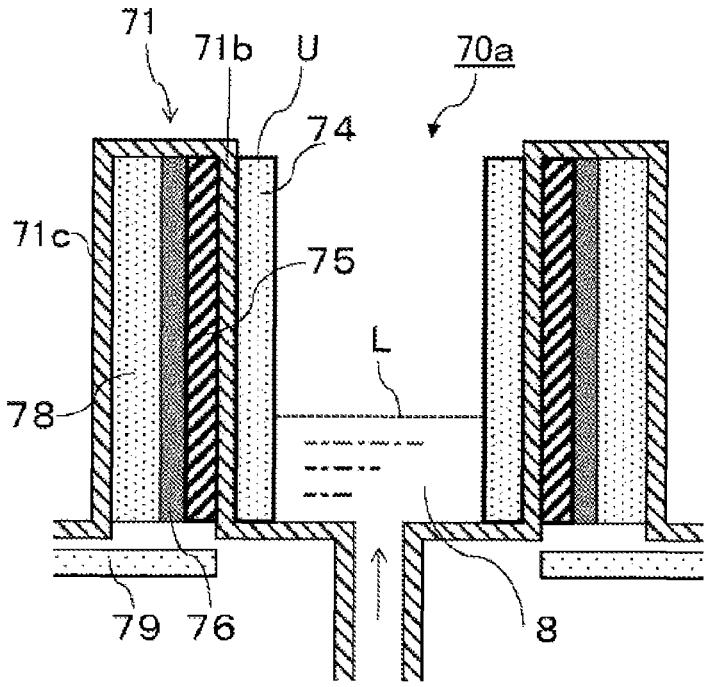
FIG. 5 is a partial sectional view of an oil vapor generator used in an oil diffusion pump of another mode corresponding to FIG. 3.
Figure 6:
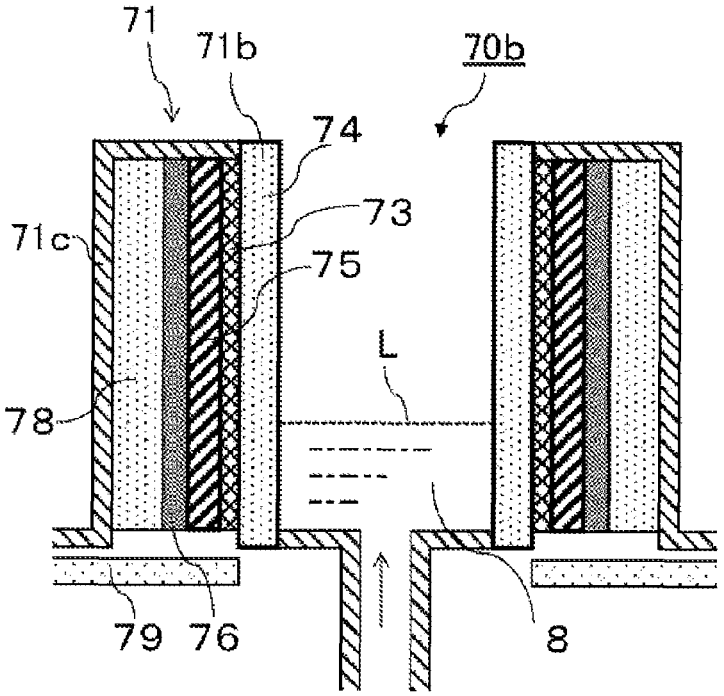
FIG. 6 is a partial sectional view of an oil vapor generator used in another mode corresponding to FIG. 3.

Note that, although the flange 79 shown in FIG. 5 and FIG. 6 is omitted in the case in FIG. 3 explained above, the case in FIG. 3 is also supported by the same flange from the atmosphere side.

Figure 7:
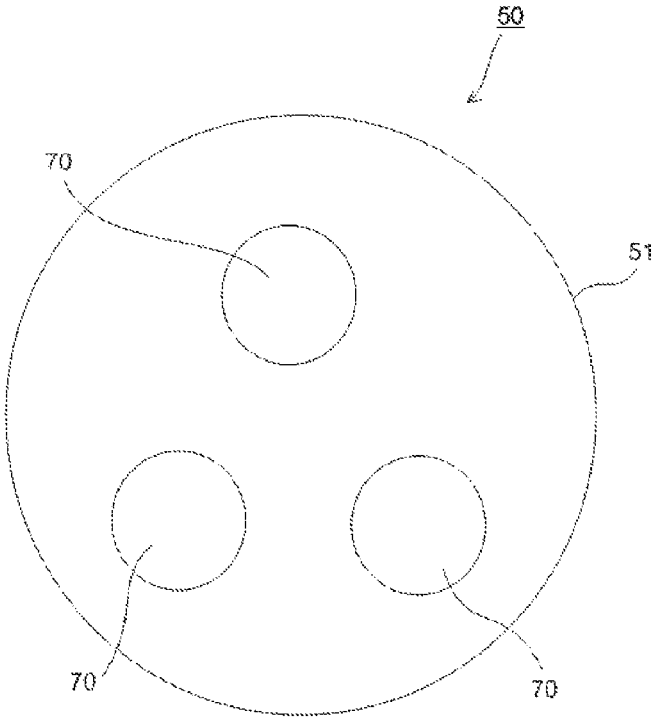
FIG. 7 is a view showing another example of an arrangement mode of oil vapor generators incorporated in the oil diffusion pump of the present example.
Figure 8:
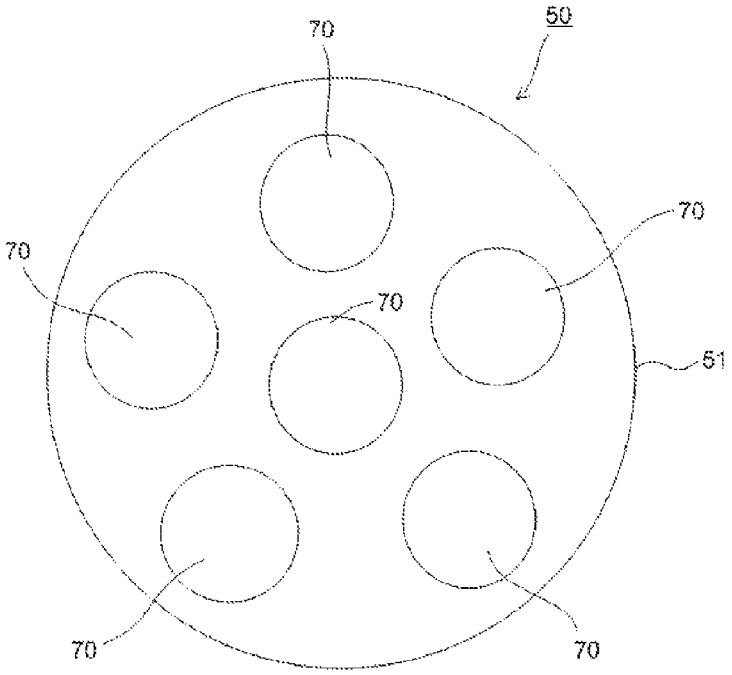
FIG. 8 is a view showing another example of an arrangement mode of oil vapor generators incorporated in the oil diffusion pump of the present example.

Also, one oil vapor generator 70 was provided to one oil diffusion pump 50 in the example explained above, however, it is not limited to this mode and, particularly in the case of seeking for a larger oil diffusion pump, for example as shown in FIG. 7 and FIG. 8, a plurality of oil vapor generators 70 of the present example may be provided on the bottom of the casing 51.

EXAMPLES

Next, an explanation will be made on an actual example (example) and a comparative example of the present invention.

Example

In the present example, an oil diffusion pump 50 (FIG. 2) explained below incorporating the oil vapor generator 70 (FIG. 3) as a heating source for an operating oil was prepared and evaluated under the condition below.

(Oil Diffusion Pump 50)
Diameter of Exhaust Port: 250 mm
Exhaust Rate: 2900 L/sec.
Ultimate Pressure in Vacuum Chamber: $6.7\times10^{-6}$ Pa or lower
Necessary Electric Power: 0.7 KW
Operating Oil: Lion S, 1 L
(Oil Vapor Generator 70)
Height of Case Inner Wall 71*b* and Case Outer Wall 71*c*: 120 mm
Oil Surface L Level of Operation Oil: 30 mm (during stop), 10 mm (during operation)

Comparative Example

In the present example, an oil diffusion pump of the conventional configuration was prepared, wherein an electric heater using a heater wire (nichrome wire) as a heating source for operating oil was arranged on the bottom of the pump, and evaluation was made under the condition below.

(Conventional Oil Diffusion Pump)
Diameter of Exhaust Port: 250 mm
Exhaust Rate: 2900 L/sec.
Ultimate Pressure in Vacuum Chamber: $6.7\times10^{-6}$ Pa or lower
Necessary Electric Power: 2.0 KW (200V)
Operating Oil: Lion S, 1 L

[Evaluation]

An operation power was measured by using an oil diffusion pump in each example. Specifically, power supply parts to the nichrome wire (the comparative example) and induction coil (the example) were measured by a clamp ammeter, a power (start-up power, operation power) was calculated from the voltage, current and power factor, and a ratio of the example to the comparative example (comparison with conventional one) was calculated. The result was that the operation power in the example was decreased by 40% at start-up and decreased by 65% during operation from those in the conventional one, and it revealed that a significant power reduction was attained both at start-up and in operation.

Temperatures (side surface, bottom surface) were measured on the oil diffusion pumps in the respective examples. The result was 170° C. on the side surface (on the atmosphere side) in the example. It was decreased by 26% comparing with that in the comparative example (230° C.), and it was confirmed that a boiler inner tube (the tubular case 71, especially the case inner wall 71*b*) was heated intensively, which can contribute to a power reduction. Also, the bottom surface temperature in the example was 120° C. It turned out that a heat loss was suppressed significantly comparing with the comparative example (red-hot state), wherein a red-hot heater block was exposed and at a very high temperature. It also turned out that a level of not needing to consider damages on the floor was attainable.

The invention claimed is:

1. An oil diffusion pump, wherein an oil vapor generator is arranged in a jet provided in a casing, the oil vapor generator is operated to vaporize an operating oil to produce oil vapor, and the oil vapor is sprayed from the jet to exhaust intake air:

the oil vapor generator comprises
- a container for storing oil therein, provided to be along a vertical direction, which is a tubular member formed by a material to be heated with a lower end thereof being closed;
- an induction coil wound around the tubular member via an insulating material; and
- a power supply means for applying an alternating current of 10 Hz to 900 Hz to the induction coil;

wherein the power supply means is configured to be operated to heat the tubular member itself so as to vaporize the oil inside the container, wherein the tubular member is configured to be provided along the vertical direction and to have a unitary double structure of tubular inner wall and outer wall displaced on both sides of a cavity part having a ring shape in a circumferential direction, and the induction coil is wound around an atmosphere-side perimeter of the inner wall via the insulating material.

2. The oil diffusion pump according to claim 1, wherein the induction coil is configured by an insulation-coated heat-resistant electric wire.

3. A vacuum film formation device, provided with an exhaust device for evacuating inside a vacuum chamber, wherein the oil diffusion pump according to claim 1 is used as the exhaust device.

4. The oil diffusion pump according to claim 1, wherein the induction coil is configured by an insulation-coated heat-resistant electric wire.

* * * * *